US007144272B1

(12) United States Patent
Burris et al.

(10) Patent No.: US 7,144,272 B1
(45) Date of Patent: Dec. 5, 2006

(54) COAXIAL CABLE CONNECTOR WITH THREADED OUTER BODY

(75) Inventors: Donald A. Burris, Peoria, AZ (US); William B. Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/273,813

(22) Filed: Nov. 14, 2005

(51) Int. Cl.
*H01R 9/05* (2006.01)

(52) U.S. Cl. ..... 439/578

(58) Field of Classification Search ..... 439/578, 439/585, 63
See application file for complete search history.

(56) References Cited

U.S. PATENT DOCUMENTS

| | | | | |
|---|---|---|---|---|
| 2,922,913 | A * | 1/1960 | Cushman | 313/581 |
| 3,212,015 | A * | 10/1965 | Kruse, Jr. | 327/583 |
| 3,541,495 | A * | 11/1970 | Grafton et al. | 439/578 |
| 3,587,033 | A * | 6/1971 | Brorein et al. | 439/322 |
| 3,601,766 | A | 8/1971 | Alibert | 339/97 |
| 4,408,822 | A | 10/1983 | Nikitas | 339/177 R |
| 5,195,906 | A * | 3/1993 | Szegda | 439/394 |
| 5,393,244 | A | 2/1995 | Szegda | 439/394 |
| 5,474,478 | A * | 12/1995 | Ballog | 439/805 |
| 5,877,452 | A | 3/1999 | McConnell | 174/88 C |
| 5,997,350 | A | 12/1999 | Burris et al. | 439/585 |
| 6,733,336 | B1 * | 5/2004 | Montena et al. | 439/578 |
| 6,976,872 | B1 * | 12/2005 | Wild et al. | 439/578 |
| 2002/0106936 | A1 * | 8/2002 | Baur | 439/578 |
| 2004/0209516 | A1 | 10/2004 | Burris et al. | 439/587 |

* cited by examiner

*Primary Examiner*—Tulsidas C. Patel
*Assistant Examiner*—Vladimir Imas
(74) *Attorney, Agent, or Firm*—Joseph M. Homa

(57) ABSTRACT

A connector for coaxial cable is disclosed herein that has an outer body, the outer body has at least one thread on a rearward portion thereof, and tubular post having at least one projection thereon. The outer body and the tubular post are movable relative to one another to compress a portion of the coaxial cable in the connector and to draw the braided shield of the coaxial cable into the connector. The present coaxial connector accommodates coaxial cables with larger amounts of braided shielding. A related method for connecting the coaxial cable and connector is also disclosed.

18 Claims, 17 Drawing Sheets

COAXIAL CABLE CONNECTOR WITH THREADED OUTER BODY

BACKGROUND OF THE INVENTION

1. Field of the Invention

The present invention relates generally to coaxial cable connectors, and particularly to coaxial drop cable connectors capable of being connected to a terminal.

2. Technical Background

Coaxial cable connectors such as F-connectors are used to attach coaxial cables to another object such as an appliance or junction having a terminal adapted to engage the coaxial cable connector. Coaxial cable F-connectors are often used to terminate a drop cable in a cable television system. The coaxial cable typically includes a center conductor surrounded by a dielectric, in turn surrounded by a conductive grounding foil and/or braided shield; the conductive grounding foil and/or braided shield are in turn surrounded by a protective outer jacket. The F-connector is secured over the prepared end of the jacketed coaxial cable, allowing the end of the coaxial cable to be connected with a terminal block, such as by a threaded connection with a threaded terminal of a terminal block.

Coaxial cable connectors can be installed on the coaxial cable by crimping the coaxial cable connector to the cable or by axial compression. These compression connectors are installed onto prepared cables by inserting the exposed cable core (dielectric and center conductor) into the connector and, more specifically, onto a post or support sleeve on the inside of the coaxial cable connector. The conductive grounding foil and braided shield are typically folded back over the protective outer jacket when the cable core is exposed. The post is interposed between the cable core (dielectric and center conductor) and the conductive grounding foil and/or braided shield. However, in certain coaxial cables, specifically head end cables (HEC), there may be multiple layers of conductive grounding foil and braided shield. The multiple layers of conductive grounding foil and braided shield cause the HEC cable to have a larger diameter than the typical coaxial cables, thereby making insertion of the prepared coaxial cable into the typical F-connectors difficult if not impossible. Thus, the termination of the HEC coaxial cables is extremely difficult, if not close to impossible, using standard techniques and materials.

While a larger coaxial cable connector may solve the problem, it would also increase the number of connectors that the tradesmen would need to stock, causing potential confusion, increased capital expenditures, and potential damage to those connectors if they are used incorrectly (on coaxial cables that are not HEC, for example). Therefore, a coaxial cable connector that can be inserted onto all types of coaxial cables, including HEC coaxial cables, is needed.

SUMMARY OF THE INVENTION

To achieve these and other advantages and in accordance with the purpose of the invention as embodied and broadly described herein, the invention is directed in one aspect to a connector for coupling an end of a coaxial cable to a terminal, the coaxial cable comprising an inner conductor, a dielectric surrounding the inner conductor, an outer conductor surrounding the dielectric, at least one braided shield surrounding the dielectric, and a jacket surrounding the at least one braided shield, the connector having an outer body comprising a rear end, a front end, a longitudinal axis, and an internal surface extending between the rear and front ends of the body, the internal surface defining a longitudinal opening and having at least one thread on at least a portion of the internal surface adjacent the rear end of the outer body, and a tubular post disposed at least partially within the longitudinal opening of the outer body, the tubular post comprising a rear end, an inner surface and an outer surface, the rear end of the tubular post having at least one protrusion on the outer surface, and wherein at least a portion of the outer surface of the tubular post and at least a portion of the internal surface of the outer body define an annular cavity therebetween, wherein the outer body and tubular post are movable relative to one another along the longitudinal axis to compress at least a portion of the coaxial cable in the connector.

In another aspect, disclosed herein is a combination of a coaxial cable and a connector for coupling an end of the coaxial cable to a terminal, the coaxial cable comprising an inner conductor, a dielectric surrounding the inner conductor, an outer conductor surrounding the dielectric, at least one braided shield surrounding the dielectric, and a jacket surrounding the at least one braided shield, the connector having an outer body comprising a rear end, a front end, a longitudinal axis and an internal surface extending between the rear and front ends of the body, the internal surface defining a longitudinal opening and having at least one thread proximate the rear end, a tubular post disposed at least partially within the longitudinal opening of the hollow body, the tubular post comprising a rear end, an inner surface and an outer surface, the rear end of the tubular post having at least one projection on the outer surface, and wherein at least a portion of the outer surface of the tubular post and at least a portion of the internal surface of the hollow body define an annular cavity therebetween, wherein the inner surface of the tubular post is configured to allow the dielectric and the inner conductor to enter the tubular post and to allow the at least one braided shield and the jacket to enter the annular cavity over the at least one projection, and a pin disposed in the tubular post to engage the inner conductor.

In another aspect, a method is disclosed for coupling a coaxial cable to a terminal, the coaxial cable having an inner conductor, a dielectric surrounding the inner conductor, an outer conductor surrounding the dielectric, a braided shield surrounding the dielectric, and a jacket surrounding the braided shield, the method including providing a coaxial connector comprising an outer body and a tubular post having at least one projection on an outer surface, the outer body being axially moveable relative to the tubular post and having at least one thread on an internal surface proximate a rear end of the outer body, engaging the coaxial cable with the outer body of the connector while rotating the outer body with respect to the coaxial cable, wherein the at least one thread draws the braided shield and jacket into an annular opening between the outer body and the outer surface of the tubular post, thereby longitudinally advancing the coaxial connector onto the coaxial cable, and moving the outer body and the tubular post relative to one another to engage a portion of the coaxial cable between the outer body and the rear end of the tubular post.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 2:
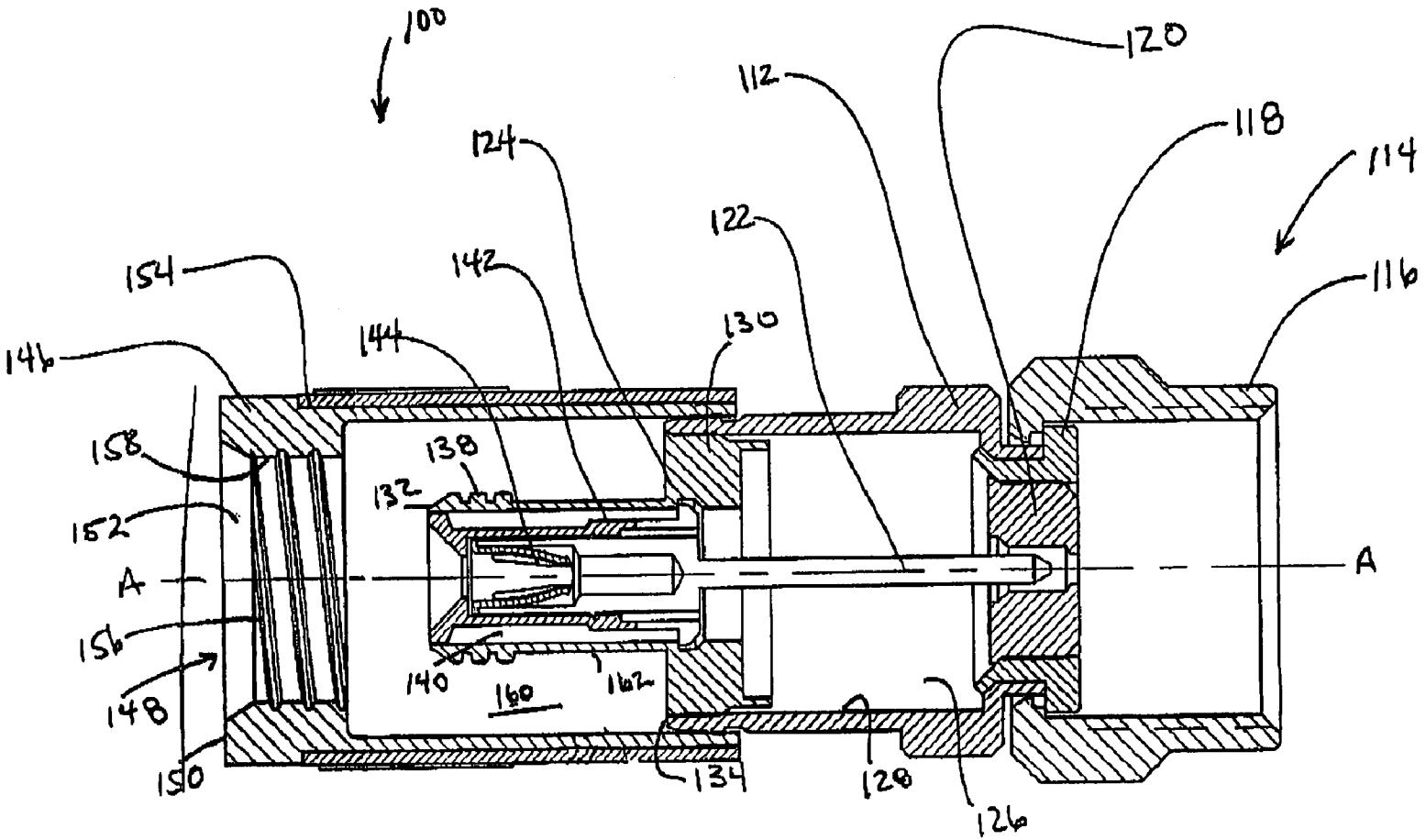
FIG. 2 is a side cutaway view along the centerline of one preferred embodiment of a coaxial cable connector according to the present invention.

Reference will now be made in detail to the present preferred embodiment(s) of the invention, examples of which are illustrated in the accompanying drawings. Whenever possible, the same reference numerals will be used throughout the drawings to refer to the same or like parts. One embodiment of the present invention is shown in FIG. 2 and is designated generally throughout by the reference numeral 100.

Figure 1:
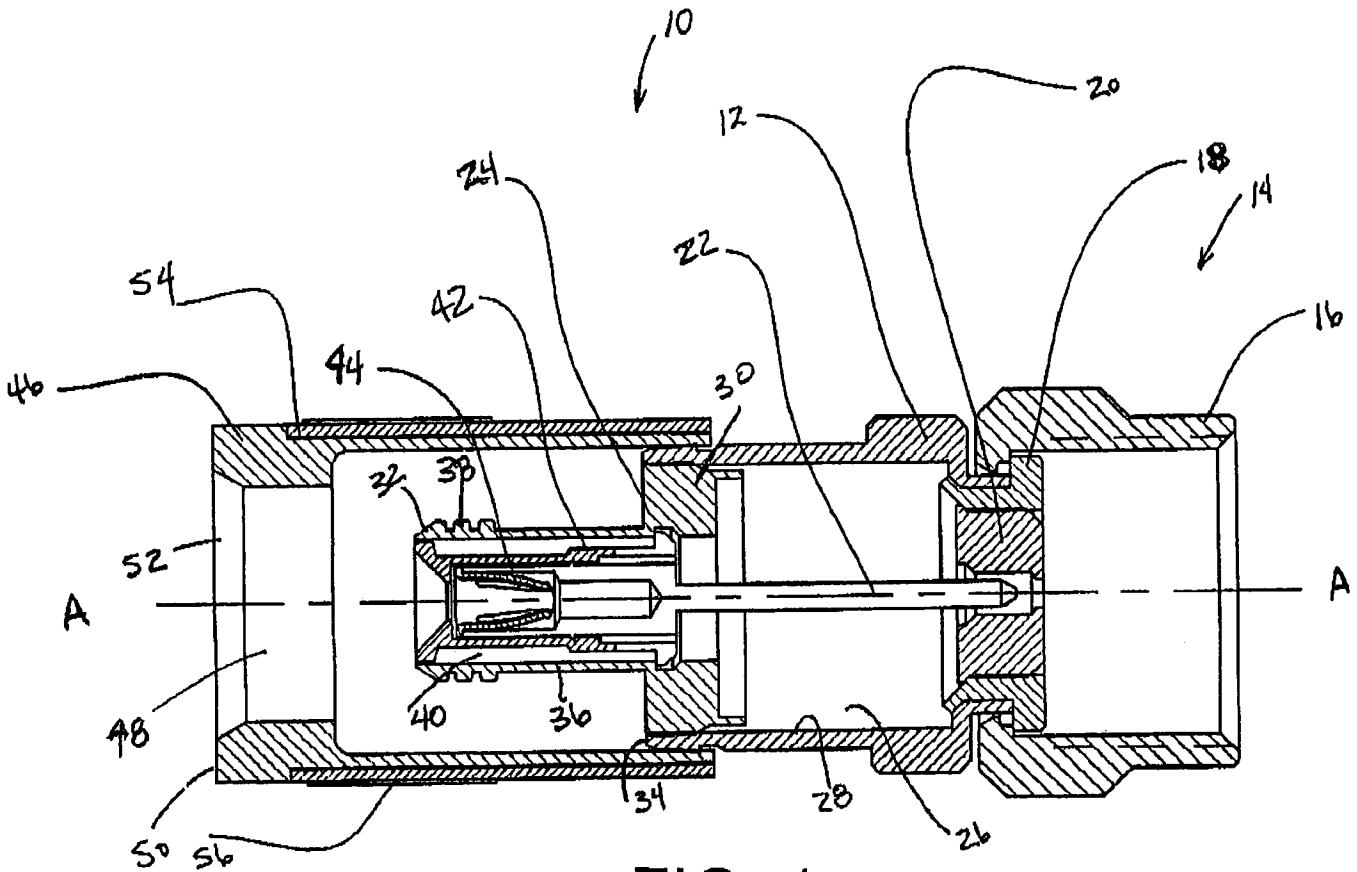
FIG. 1 PRIOR ART
FIG. 1 is a side cutaway view along the centerline of an axial compression connector according to the prior art.
Figure 15:
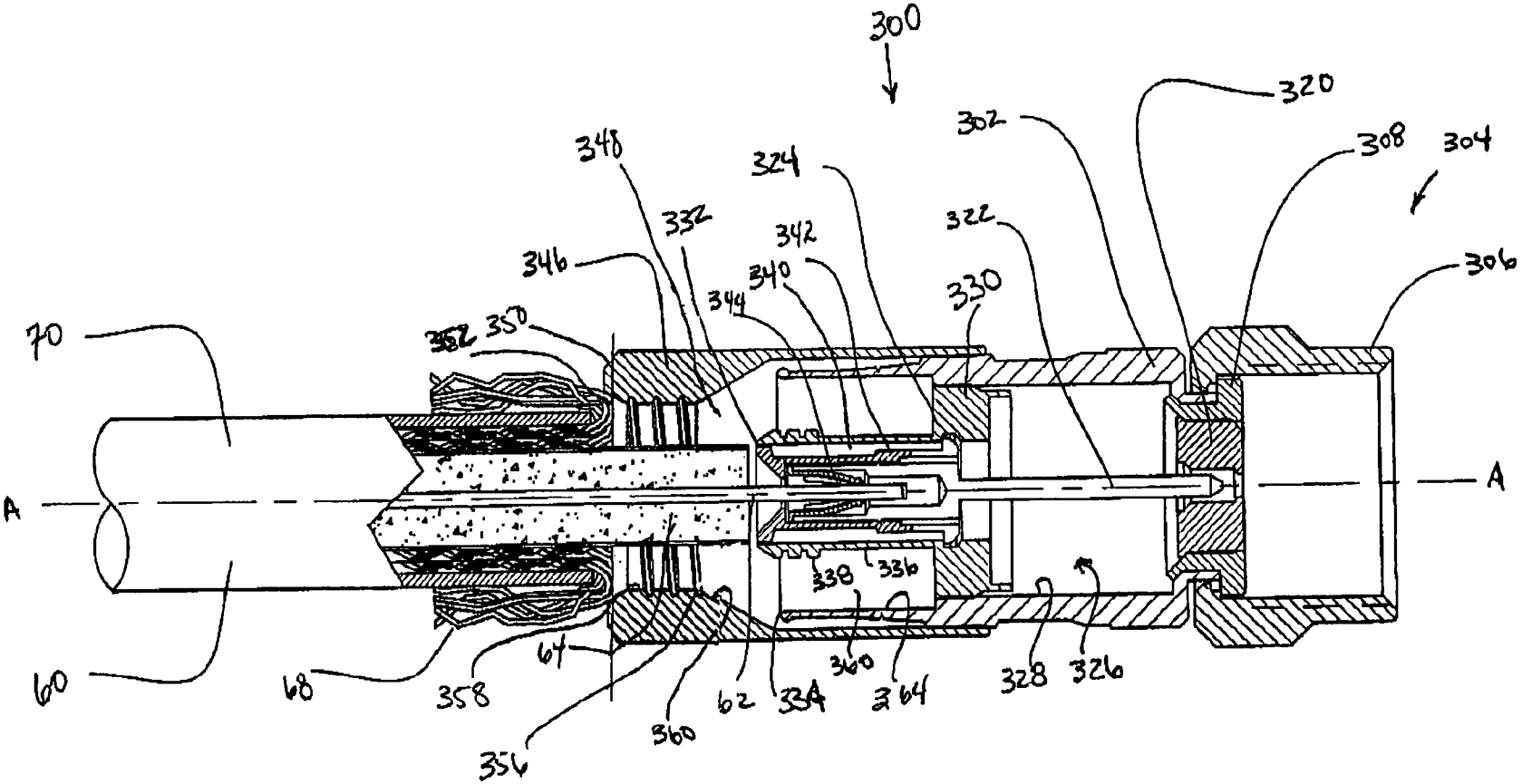
FIG. 15 is a side cutaway view along the centerline of another preferred embodiment of a coaxial cable connector according to the present invention with a coaxial cable engaging the outer body.
Figure 16:
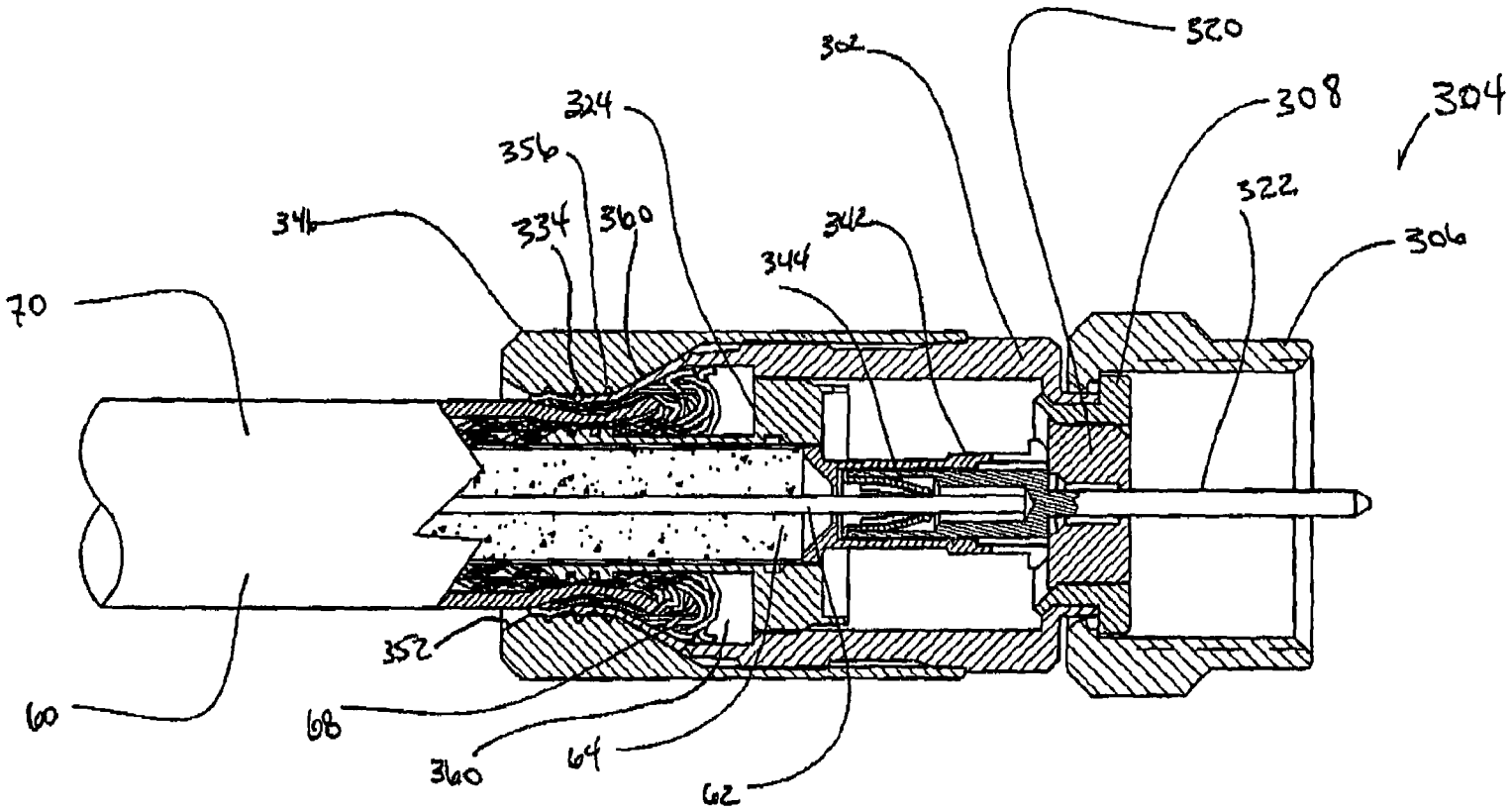
FIG. 16 is a side cutaway view of the coaxial cable connector of FIG. 15 after the coaxial cable has been inserted and axial compression of the coaxial cable connector.
Figure 17:
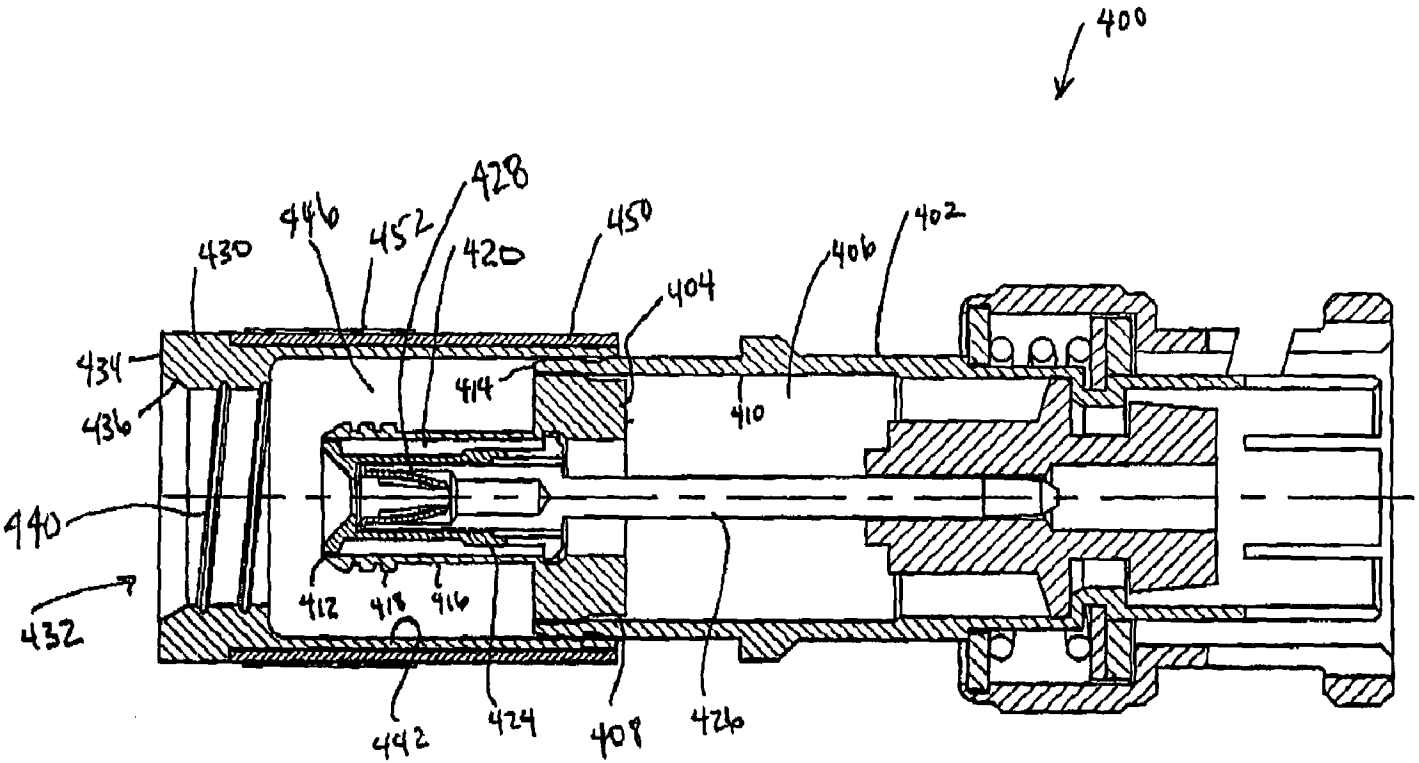
FIG. 17 is a side cutaway view along the centerline of another preferred embodiment of a coaxial cable connector according to the present invention.

FIG. 1 schematically illustrates a coaxial cable connector 10 according to the prior art. FIG. 2 schematically illustrates one preferred embodiment of a coaxial cable connector 100, as disclosed herein, in an open configuration. FIGS. 3–7 illustrate the coaxial cable connector 100 and the insertion onto a coaxial cable 60 in greater detail. FIG. 8 illustrates an alternative embodiment of the coaxial cable connector in FIG. 2. FIGS. 9–14 illustrate an alternative embodiment of a coaxial cable connector according to the present invention. FIGS. 15–16 illustrate another alternative embodiment of a coaxial cable connector according to the present invention. FIG. 17 illustrates yet another embodiment a coaxial cable connector according to the present invention.

Figure 3:
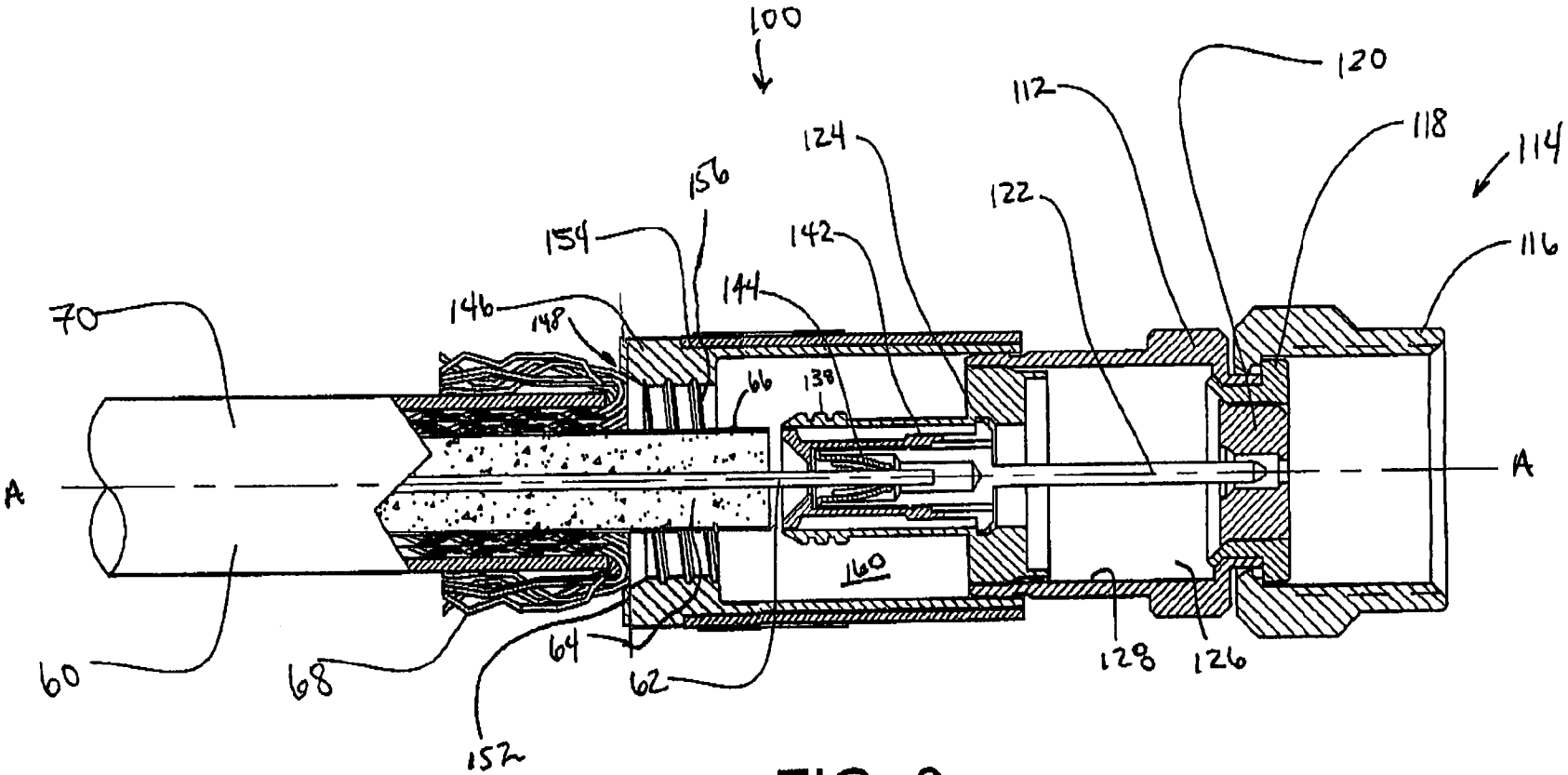
FIG. 3 is a side cutaway view of the coaxial cable connector of FIG. 2 with a coaxial cable being inserted.

Referring to FIG. 1, the prior art coaxial cable connector 10 couples an end of a coaxial cable to a terminal. One example of a coaxial cable 60, shown in FIG. 3, comprises an inner conductor 62, a dielectric layer (or, simply, dielectric) 64 surrounding the inner conductor 62, an outer conductor 66 surrounding the dielectric 64, a braided shield 68 surrounding the dielectric 64, and a jacket 70 surrounding the braided shield 68. The braided shield 68 may include more than one layer of braided shield. For example, in many head end cables there are many layers of braided shield with a layer of outer conductor 66 disposed between each of the layers of braided shield. As illustrated in FIG. 3, the first layer of outer conductor 66 is typically secured to the dielectric 64 and is not folded back over the jacket 70 with the other layers. However, if there are multiple layers of braided shield and outer conductors, the additional layers (interlaced between the braided shield layers) may be folded back with the braided shield 68 (See FIG. 3) and are referred to collectively herein as braided shield.

The prior art coaxial cable connector 10 has a hollow body 12 that has a longitudinal axis A—A. At the front end 14 of coaxial cable connector 10 is a coupler, shown as embodied by a coupling nut 16. The coupling nut 16 is shown with a generally hexagonal outer configuration with internal threads for engaging an appliance or junction having a terminal. At the front end of hollow body 12 is a nut retainer 18 that secures the coupling nut 16 to the hollow body 12. The nut retainer 18 provides limited axial movement while allowing full rotational motion of the coupling nut 16. Disposed within the nut retainer 18 is an insulator 20. The insulator 20 provides mechanical support and a guide for centering pin 22. The insulator 20 also serves to electrically match the coaxial structure impedance of the connector, and is typically made of a nonconductive plastic material, such as acetyl.

A tubular post 24 is disposed within a longitudinal opening 26 of hollow body 12. The tubular post 24 has a front end 30 that engages the internal surface 28 of the hollow body 12 and a rear end 32 that preferably protrudes from the rear end 34 of the hollow body 12. The outer surface 36 of the tubular post 24 has at least one projection 38 to engage the coaxial cable 60.

Disposed within the longitudinal opening 40 of tubular post 24 is a second insulator 42 that, in addition to insulator 20, provides mechanical support for the pin 22. It also acts as a guide for centering pin 22 within the tubular post 24.

A contact 44 is mounted internally in pin 22 by means of the press-fit to provide electrical and mechanical engagement between the pin 22 and the inner conductor 62 of the coaxial cable 60 with a spring clip.

The prior art connector 10 has an outer body 46 that is slideably mounted to the hollow body 12 by use of barb/press-fit configuration. As illustrated in FIG. 1, the rear end 32 of tubular post 24 extends into a longitudinal opening 48 of outer body 46. The rear end 50 of outer body 46 has a chamfered portion 52 to receive the coaxial cable 60.

A shell 54 is press-fit over the outer body 46 to provide additional mechanical strength to the outer body 46. The shell 54 is preferably made of a metal material, while the outer body 46 is typically made from a plastic material. Some of the prior art connectors 10 may also have a label 56 to identify the coaxial cable connector 10.

Coaxial cable connector 100 is schematically illustrated in FIGS. 2–7. Coaxial cable connector 100 has a longitudinal axis A—A and a hollow body 112. The hollow body 112 is preferably made from a metallic material, such as brass, and is preferably plated with a conductive, corrosion resistant material, such as nickel. At the front end 114 of coaxial cable connector 100 is a coupler, shown as embodied by a coupling nut 116. The coupling nut 116 is shown with a generally hexagonal outer configuration with internal threads for engaging an appliance or junction having a terminal. The coupling nut 116 is also preferably made of a metallic material, such as brass, and it is also preferably plated with a conductive, corrosion resistant material, such as nickel. At the front end of hollow body 112 is a nut retainer 118 that secures the coupling nut 116 to the hollow body 112. The nut retainer 118 is preferably made from the same material as the coupling nut 116. The nut retainer 118 provides limited axial movement while allowing full rotational motion of the coupling nut 116. Disposed within the nut retainer 118 is an insulator 120. The insulator 120 provides mechanical support and a guide for centering a pin 122. The insulator 120 also serves to electrically match the coaxial structure impedance of the coaxial cable connector 100, and is preferably made of a nonconductive plastic material, such as acetyl. The pin 122 is preferably made for a metallic material, such as brass, and is plated with a conductive material, such as gold, tin, or nickel-tin.

A tubular post 124, disposed within a longitudinal opening 126 of hollow body 112, is preferably made from a metallic material such as brass and is typically plated with a conductive, corrosion resistant material, such as tin or nickel-tin. The tubular post 124 has a front end 130 that engages the internal surface 128 of the hollow body 112 and a rear end 132 that preferably protrudes from the rear end 134 of the hollow body 112. The outer surface 136 of the tubular post 124 has at least one projection 138 to engage the coaxial cable 60. While three projections 138 are illustrated, there can be more or fewer and they may also have a helical configuration and still fall within the scope of the present invention.

Disposed within the longitudinal opening 140 of tubular post 124 is a second insulator 142 that, in addition to insulator 120, provides mechanical support for the pin 122. It also acts as a guide for centering a pin 122 within the tubular post 124. Second insulator 142 is preferably made from a non-conductive plastic material, such as acetyl.

A contact 144 is mounted internally in pin 122 by means of the press-fit to provide electrical and mechanical engagement between the pin 122 and the inner conductor 62 of the coaxial cable 60 with a spring clip. The contact 144 is preferably made from a resilient, conductive material, such as beryllium copper and plated with a conductive material, such as gold.

The coaxial cable connector 100 has an outer body 146 that is slideably mounted to the hollow body 112 by use of barb/press-fit configuration. The outer body 146 is preferably made from a plastic material such as acetyl, but may also be constructed of an appropriate metallic material. As illustrated, the rear end 132 of tubular post 124 extends into a longitudinal opening 148 of outer body 146. The rear end 150 of outer body 146 has a chamfered portion 152 to receive the coaxial cable 60. Outer body 146 of coaxial cable connector 100 has at least one thread 156 on the internal surface 158 adjacent the rear end 150. The thread 156 illustrated in the embodiment in FIGS. 2–7 has at least two complete, contiguous turns, but the thread 156 may have fewer or more, and the thread 156 may also be interrupted (i.e., not continuous) and still come within the scope of the present invention. The at least one thread 156 may also include multiple start threads, including two or three multiple start threads, if so desired. As illustrated in the figures and as discussed below with reference to the other figures, when the outer body 146 is rotated with respect to coaxial cable 60 (counterclockwise rotation as shown in FIG. 2), the thread 156 acts like an auger to pull the coaxial cable 60 and braided shield 68 into the longitudinal opening 148 and particularly an annular cavity 160 formed by the outer surface 162 of the tubular post 124 and the inner surface 158 of the outer body 146.

A shell 154 is preferably press-fit over the outer body 146 to provide additional mechanical strength to the outer body 146. The shell 154 is preferably made of an appropriate metallic material, while the outer body 146 is preferably made from a plastic material. The coaxial cable connector 100 may also have a label 156 for identification.

As illustrated in FIG. 3, the prepared coaxial cable 60 is inserted into the longitudinal opening 148 of the outer body 146. The chamfered portion 152 assists directing the outer portion of the coaxial cable into the longitudinal opening 148. As the coaxial cable 60 is inserted, the inner conductor 62 engages the contact 144 of the pin 122.

Figure 4:
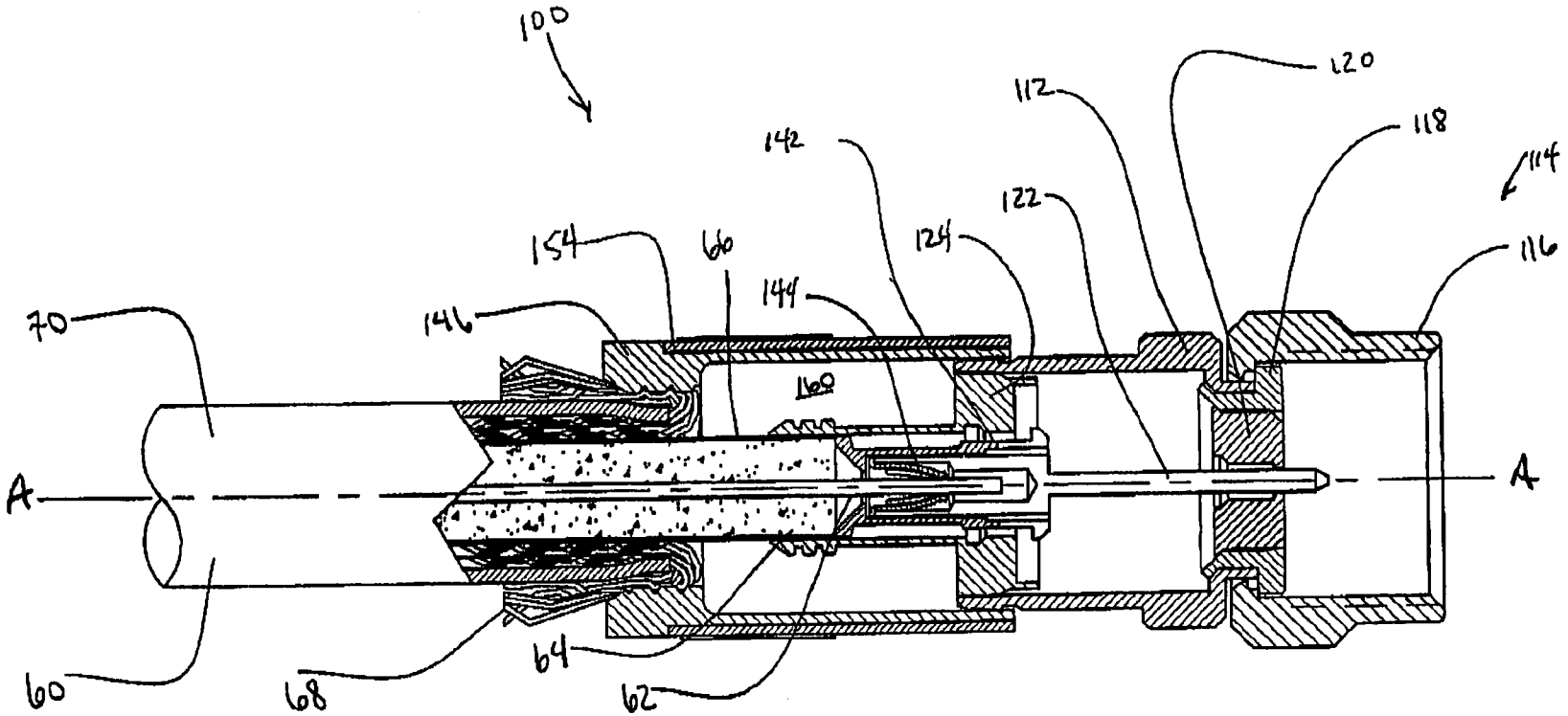
FIG. 4 is a side cutaway view of the coaxial cable connector of FIG. 2 with the coaxial cable engaging the outer body.

Coaxial cable connector 100 and coaxial cable 60 are then rotated relative to one another. For example, coaxial cable connector 100 is then rotated relative to the coaxial cable 60, causing the thread 156 to engage the braided shield 68 (and indirectly cable jacket 70 due to the compression of the coaxial cable 60) as illustrated in FIG. 4. The coaxial cable 60 may also be rotated relative to the coaxial cable connector 100. The thread 156 acts like an auger to pull the coaxial cable 60 into the coaxial cable connector 100. As noted above, the amount of braided shield 68 may be too large for the coaxial cable 60 to simply slip into the longitudinal opening 148 of the coaxial cable connector 100. Thus, the coaxial cable connector 100 compresses the braided shield 68 and jacket 70 around the coaxial cable 60, providing grip to allow the coaxial cable 60 to be axially pulled into the coaxial connector 100 during the relative rotation therebetween. As can also be seen in FIG. 4, the front end of the dielectric 64 engages the rear end of the second insulator 142. As the coaxial cable 60 moves into the coaxial cable connector 100, the second insulator 142, the contact 144 (which is now in electrical communication with the inner conductor 62), and the pin 122 also move toward the front end 114 of the coaxial cable connector 100 along the longitudinal axis A—A as the dielectric 64 pushes the second insulator 142.

Figure 5:
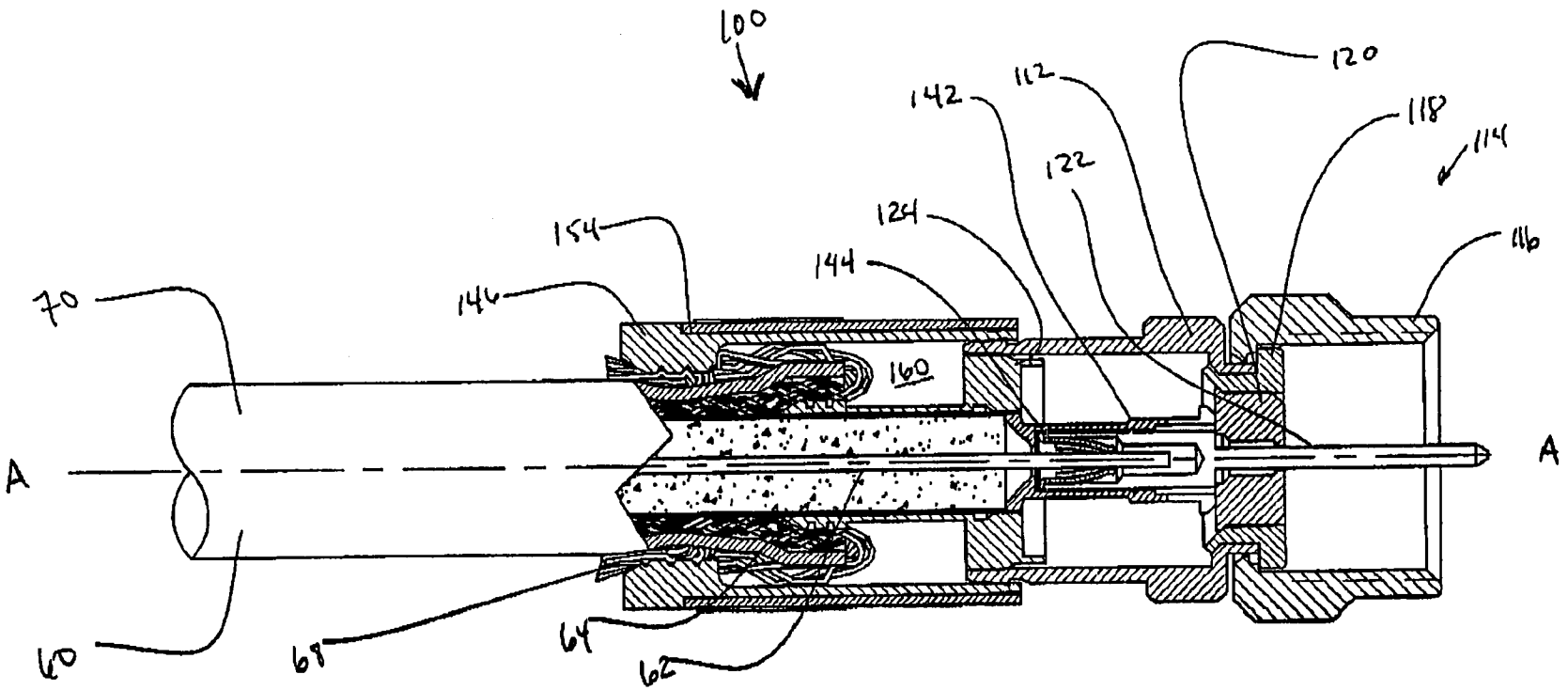
FIG. 5 is a side cutaway view of the coaxial cable connector of FIG. 2 with a coaxial cable fully inserted, but with braided shield extending out the rear of the coaxial cable connector.
Figure 6:
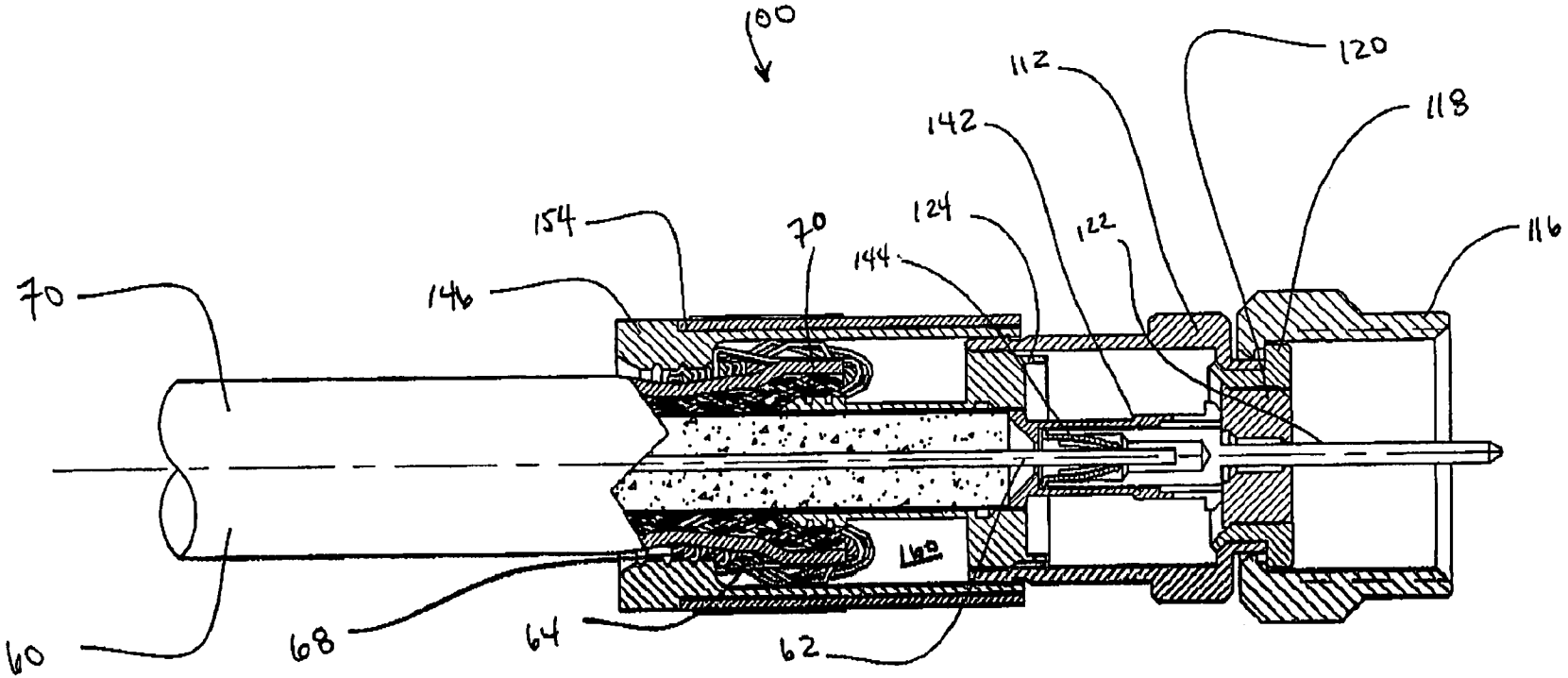
FIG. 6 is a side cutaway view of the coaxial cable connector of FIG. 2 with the braided shield drawn into the coaxial cable connector and prior to axial compression of the coaxial cable connector.

With reference to FIG. 5, once the coaxial cable 60 has advanced sufficiently in the coaxial connector 100, for example, to cause rear end 132 of post 124 to wedge between the outer conductor 66 and braided shield 68 (and the pin 122 has advanced forward within the coupling nut 116), if the coaxial connector 100 is continued to be rotated relative to the coaxial cable 60, further rotation of the coaxial cable connector 100 causes the thread 156 to pull the braided shield 68 more fully into the coaxial cable connector 100. See also FIG. 6 where the braided shield 68 is completely within the coaxial cable connector 100.

Figure 7:
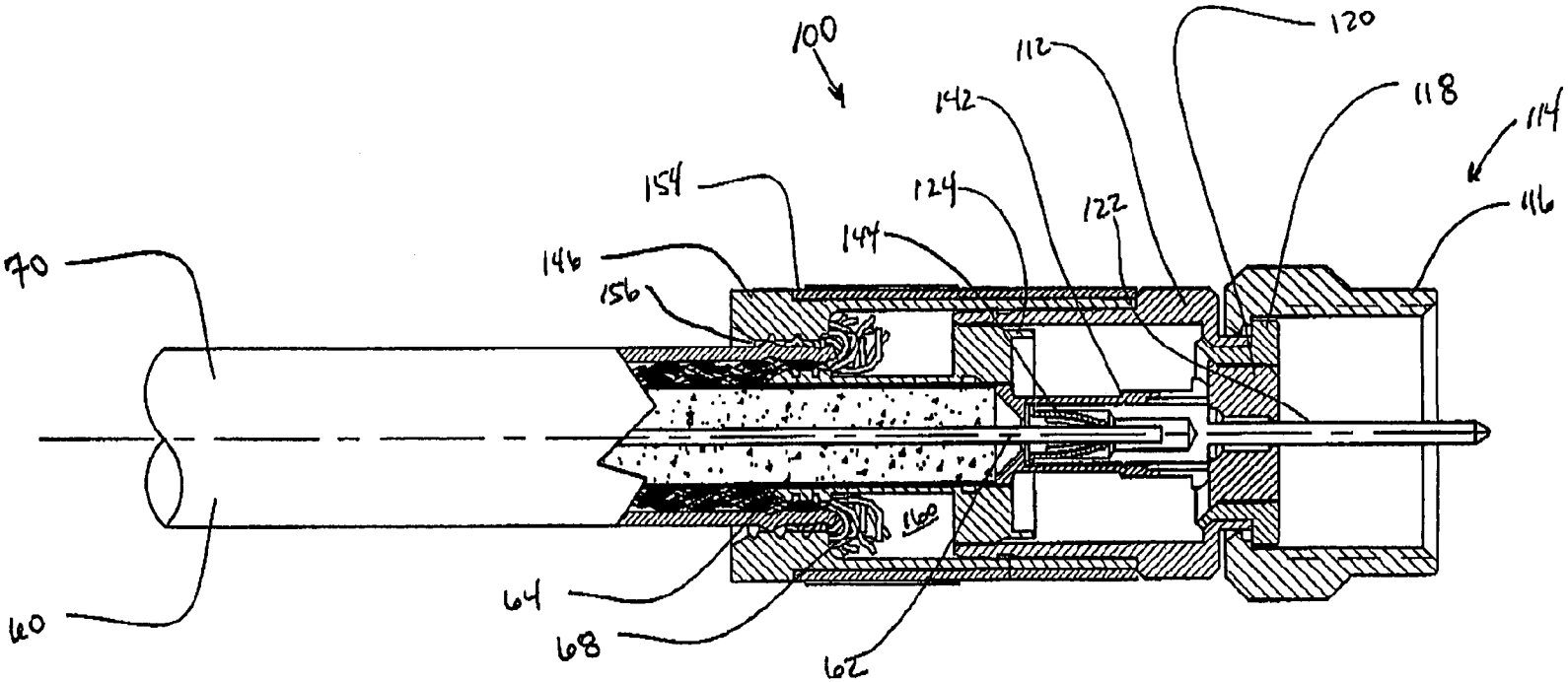
FIG. 7 is a side cutaway view of the coaxial cable connector of FIG. 6 after axial compression of the coaxial cable connector.
Figure 8:
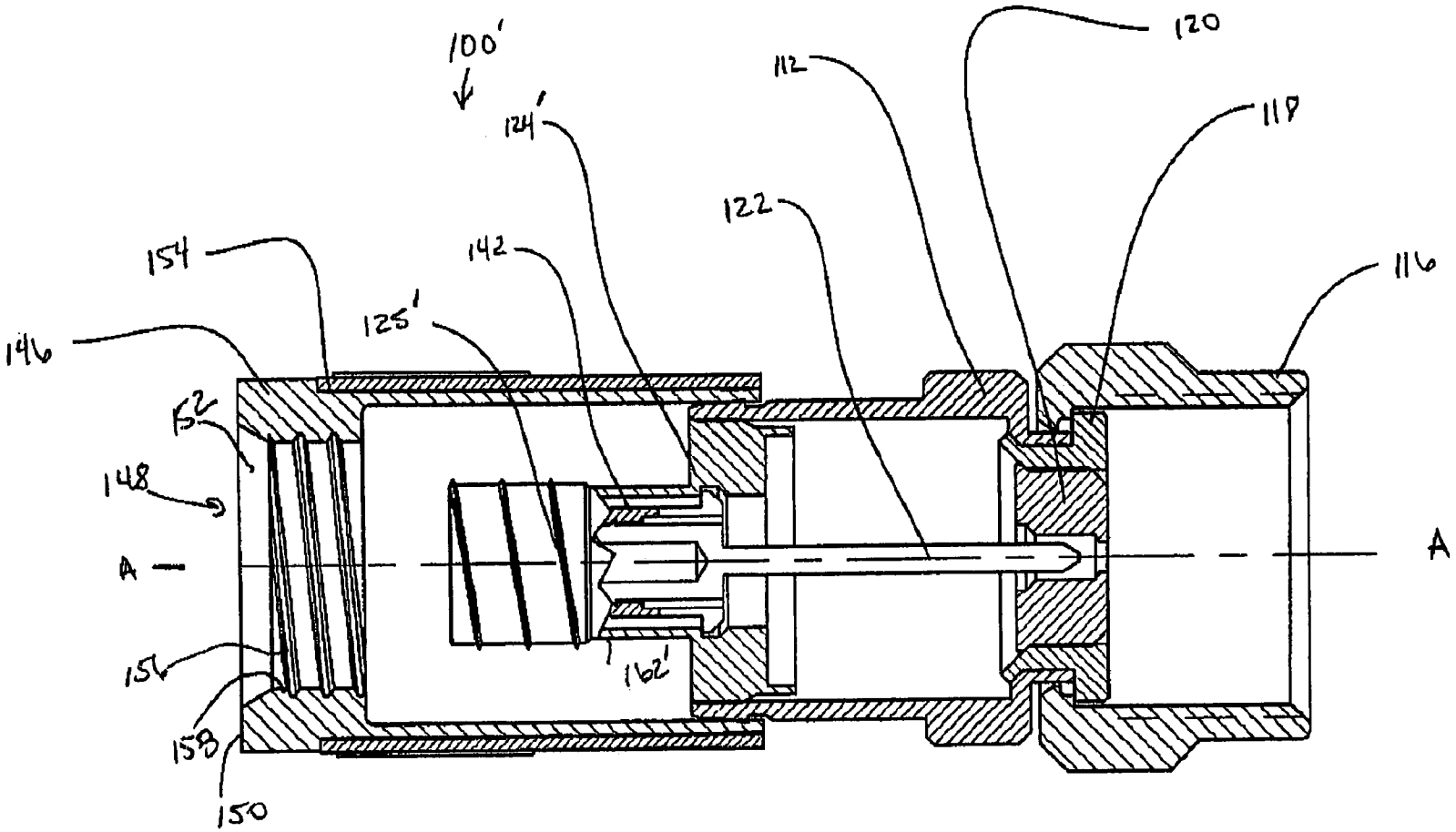
FIG. 8 is a partial side cutaway view along the centerline of a second preferred embodiment of a coaxial cable connector according to the present invention.

Once the coaxial cable connector 100 is correctly positioned on the coaxial cable 60 and the braided shield is drawn into the coaxial cable connector 100 (if so desired, the extra braided shield 68 could also be cut off), the coaxial cable connector 100 is axially compressed as is known in the art, as illustrated in FIG. 7. The compression of the coaxial cable connector 100 causes the outer body 146 and hollow body 112 to move axially toward each other along axis A—A. The thread 156 will retain at least a portion of the braided shield 68 as the outer body 146 moves forward relative to the coaxial cable 60. As can be seen in FIG. 7, the thread 156 is axially positioned over the at least one projection 138 on the tubular post 124 to provide further grip between the coaxial cable 60 and the coaxial cable connector 100.

An alternative embodiment of the coaxial cable connector is illustrated in FIG. 8 as coaxial cable connector 100'. As can be seen in FIG. 8, the coaxial cable connector 100' has the same components as that of the coaxial cable connector 100 illustrated in FIGS. 2–7, but has a different tubular post 124'. More specifically, coaxial cable connector 100' has a longitudinal axis A—A, a hollow body 112, and a coupling nut 116. At the front end of hollow body 112 is a nut retainer 118 that secures the coupling nut 116 to the hollow body 112. Disposed within the nut retainer 118 is an insulator 120. The insulator 120 provides mechanical support and a guide for centering a pin 122.

Coaxial cable connector 100' has an outer body 146 that is slideably mounted to the outer body 112 by use of barb/press-fit configuration. A shell 154 is preferably press-fit over the outer body 146 to provide additional mechanical strength to the outer body 146. The rear end 150 of outer body 146 has a chamfered portion 152. Outer body 146 of coaxial cable connector 100' has at least one thread 156 on the internal surface 158 adjacent the rear end 150.

The outer surface 162' of the tubular post 124' has a different configuration than in the previous embodiment. As can be seen in FIG. 8, the outer surface 162' has at least one thread 125' disposed on the outer surface 162'. The thread 125' illustrated in FIG. 8 has at least two complete, contiguous turns, but it may have fewer or more, and it may also be interrupted (i.e., not continuous) and still come within the scope of the present invention. The thread 125' may also include multiple start threads, including two or three multiple start threads, if so desired. Thread 125' preferably has the same rotational orientation as thread 156, for example both are left-handed threads, or both are right-handed threads.

Another embodiment of a coaxial cable connector 200 according to the present invention is illustrated in FIGS. 9–14. Coaxial cable connector 200 has an outer body 202, a shell 204, a tubular post 206, and a coupling nut 208. The coaxial cable connector 200 may also have a label 210 to identify the coaxial cable connector 200.

Figure 9:
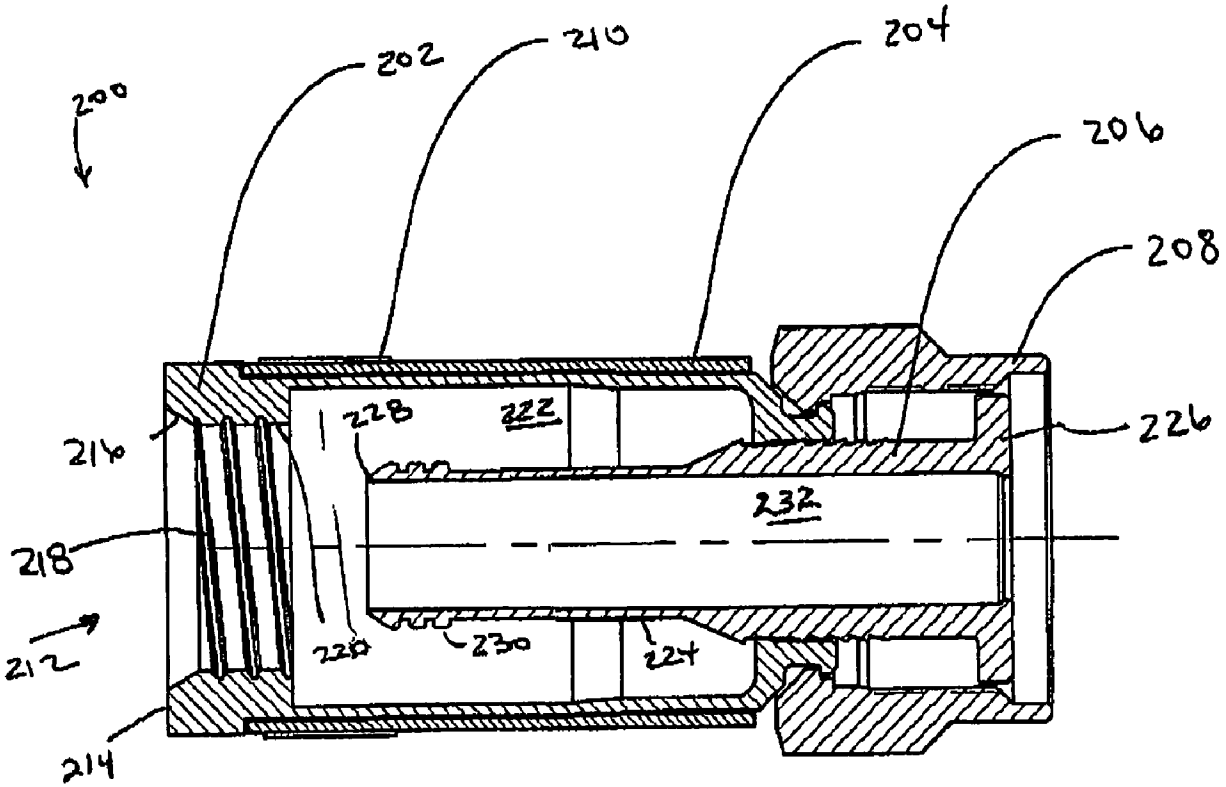
FIG. 9 is a side cutaway view along the centerline of another preferred embodiment of a coaxial cable connector according to the present invention.

The outer body 202 is slideably mounted to the tubular post 206 by use of barb/press-fit configuration, and remains in the open configuration in FIG. 9 until the coaxial cable connector 200 is later compressed. The outer body 202 is preferably made from a plastic material such as acetyl, but may also be constructed of a metallic material. As illustrated, the rear end 228 of tubular post 206 extends into a longitudinal opening 212 of outer body 202. The rear end 214 of outer body 202 has a chamfered portion 216 to assist in guiding the coaxial cable 60 into the outer body 202. Outer body 202 of coaxial cable connector 200 has at least one thread 218 on the internal surface 220 adjacent the rear end 214. The thread 218 illustrated in this embodiment has at least two complete, contiguous turns, but the thread 218 may have fewer or more, and the thread 218 may also be interrupted (i.e., not continuous) and still come within the scope of the present invention. As noted above, the thread 218 acts like an auger to pull the coaxial cable 60, and more particularly the braided shield 68 and jacket 70 into the longitudinal opening 212 and particularly an annular cavity 222 formed by the outer surface 224 of the tubular post 204 and the internal surface 220 of the outer body 202.

The coupling nut 208 is shown with a generally hexagonal outer configuration with internal threads for engaging an appliance or junction having a terminal. The coupling nut 208 is also preferably made of a metallic material such as brass, and it is also preferably plated with a conductive, corrosion resistant material, such as nickel. The coupling nut 208 is attached to the outer body 202 by a barb/press fit configuration that allows the coupling nut 208 to rotate relative to the outer body 202.

The tubular post 206, disposed within the longitudinal opening 212 of hollow body 202, is preferably made from a metallic material such as brass and is also preferably plated with a conductive, corrosion resistant material, such as tin or nickel-tin. The tubular post 206, as noted briefly above, is slideably disposed in the outer body 202 by a shoulder on the coupling nut 208 that engages a lip on the outer body 202. The tubular post 206 is illustrated in a forward position and is moved to a rearward position upon installation of the coaxial cable 60 as noted in detail below during compression. The tubular post 206 has a front end 226 and a rear end 228. The outer surface 224 of the tubular post 206 has at least one projection 230 to engage the coaxial cable 60. While three projections 230 are illustrated, there can be more or fewer and they may also have a helical configuration and still fall within the scope of the present invention. The projections may also be a thread as illustrated and described with reference to FIG. 8.

Figure 10:
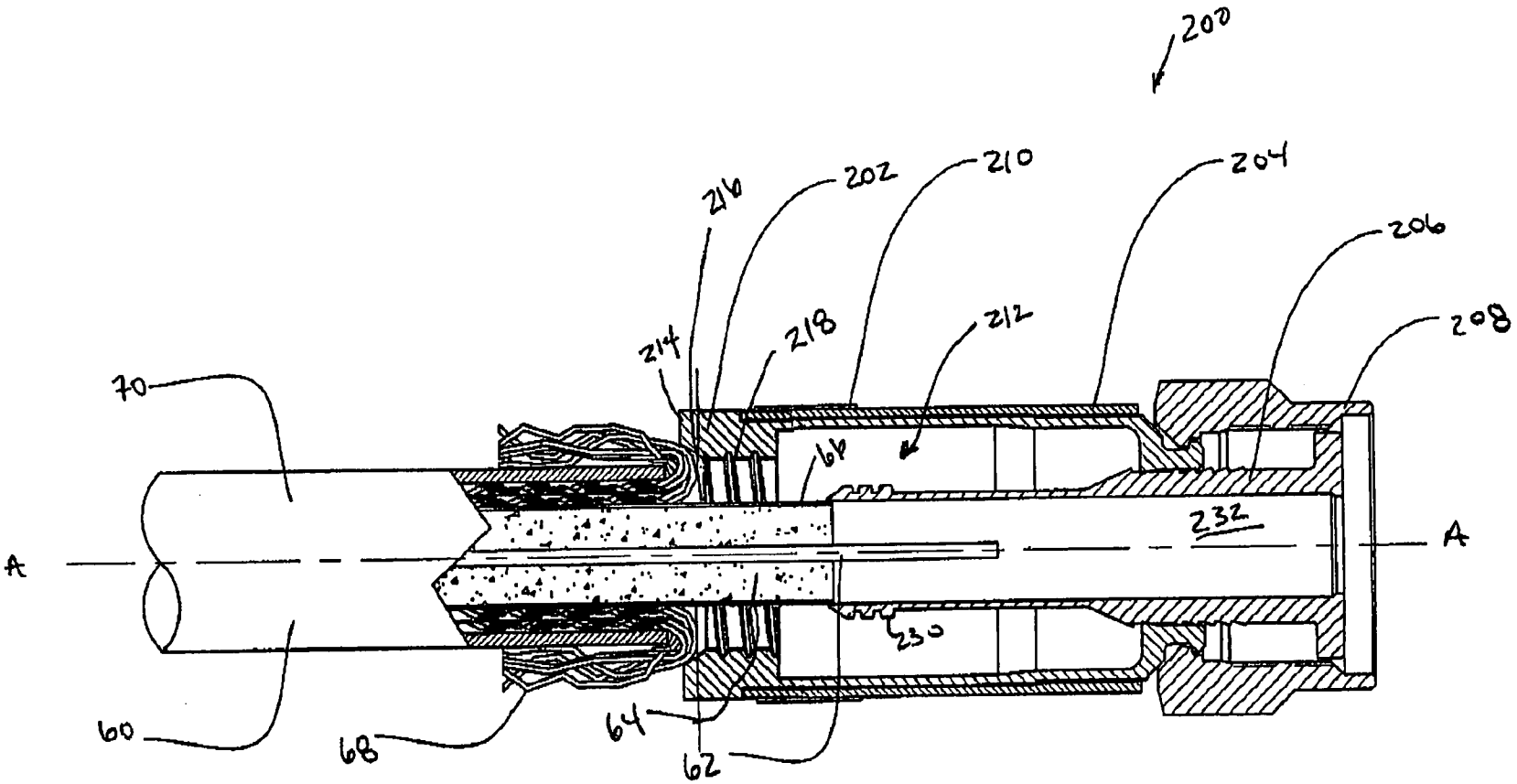
FIG. 10 is a side cutaway view of the coaxial cable connector of FIG. 9 with a coaxial cable being inserted.

Referring now to FIG. 10, the prepared coaxial cable 60 is inserted into the longitudinal opening 212, assisted by the chamfered portion 216 at the rear end 214 of outer body 202. The dielectric 64 and the outer conductor 66 (as well as the inner conductor 62) are aligned with and are inserted into the longitudinal opening 232 of the tubular post 206.

Figure 11:
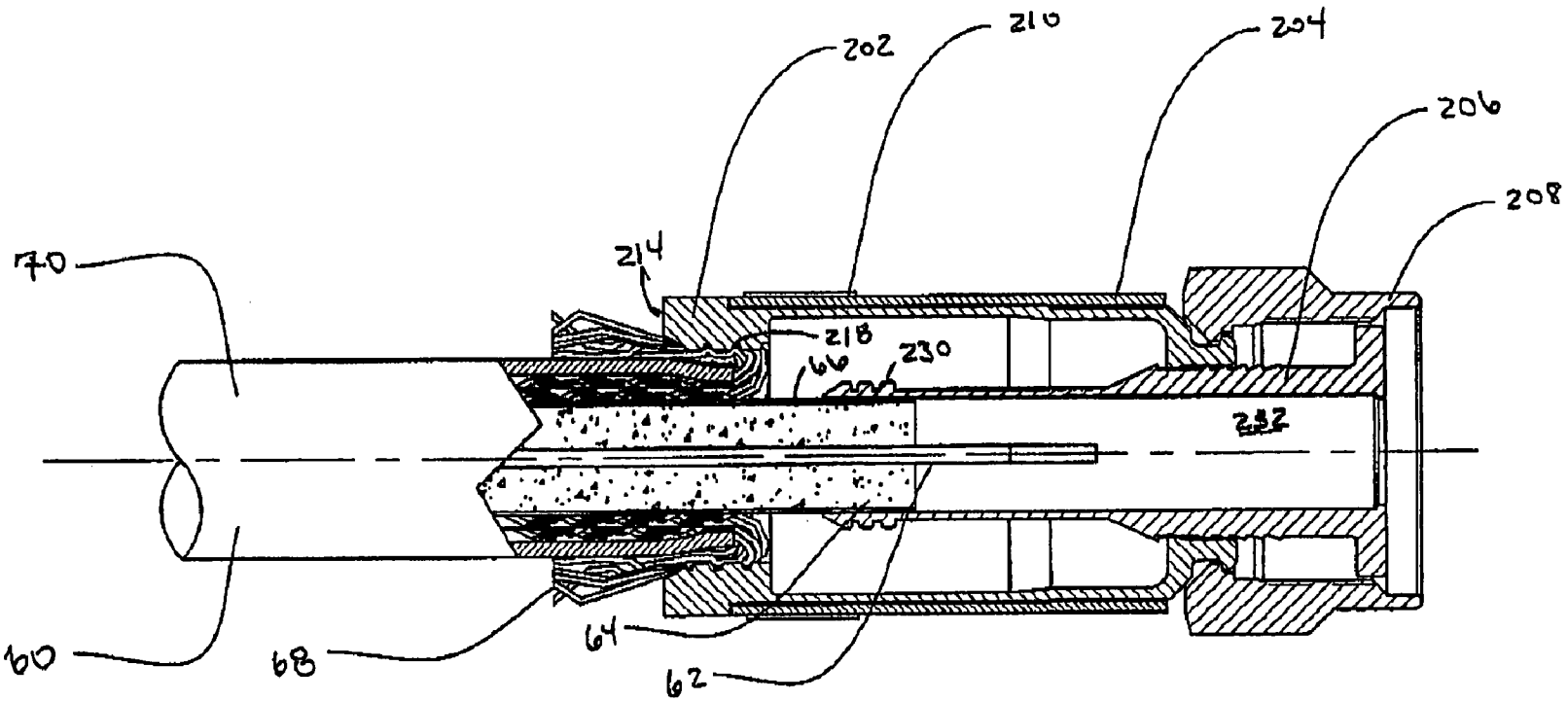
FIG. 11 is a side cutaway view of the coaxial cable connector of FIG. 9 with the coaxial cable engaging the outer body.

The coaxial cable connector 200 is then rotated relative to the coaxial cable 60, causing the thread 218 to engage at least the braided shield 68 as illustrated in FIG. 11. The thread 218 acts like an auger to pull the coaxial cable 60 into the coaxial connector 200. As with the embodiment described above, the amount of braided shield 68 may be too large for the coaxial cable to simply slip inside the coaxial cable connector 200. Thus, the coaxial cable connector 200 compresses the braided shield 68 and jacket 70 around the coaxial cable 60, providing grip to allow the coaxial cable 60 to be pulled into the coaxial connector 200. As the coaxial cable 60 moves into the coaxial cable connector 200, the inner conductor 62, dielectric 64, and outer conductor 66, move toward the front end 226 of the tubular post 206 along the longitudinal axis A—A.

Figure 12:
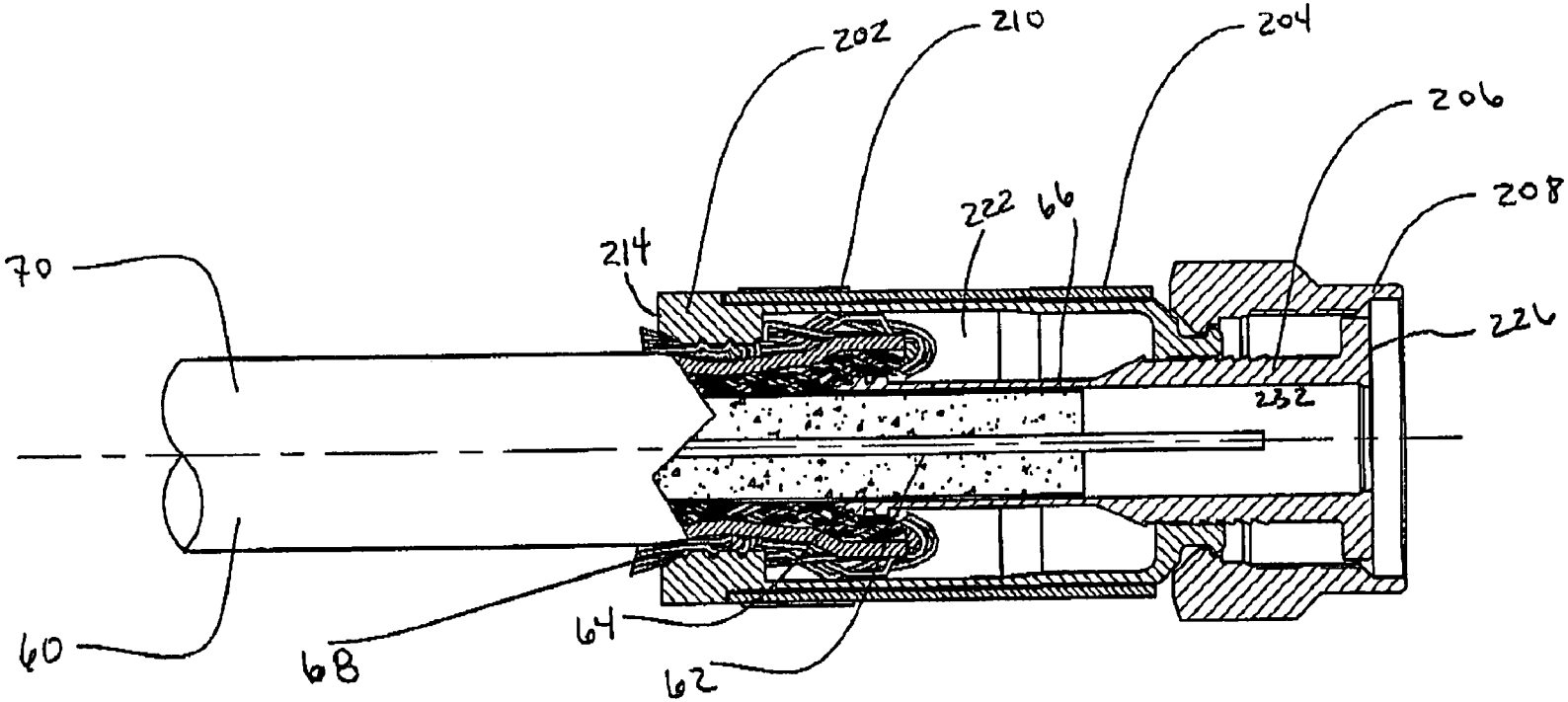
FIG. 12 is a side cutaway view of the coaxial cable connector of FIG. 9 with a coaxial cable partially inserted and the braided shield extending out the rear of the coaxial cable connector.

FIG. 12 illustrates the coaxial cable connector 200 with the coaxial cable 60 in a partially installed position. The coaxial cable jacket 70 and braided shield 68 have been pulled into the longitudinal opening 212 and into the annular cavity 222. The coaxial cable jacket 70 and braided shield 68 have moved over the projections 230 on the tubular post 206. The inner conductor 62, dielectric 64, and outer conductor 66 have continued to move along the longitudinal opening 232 of the tubular post 206 toward the front end 226.

Figure 13:
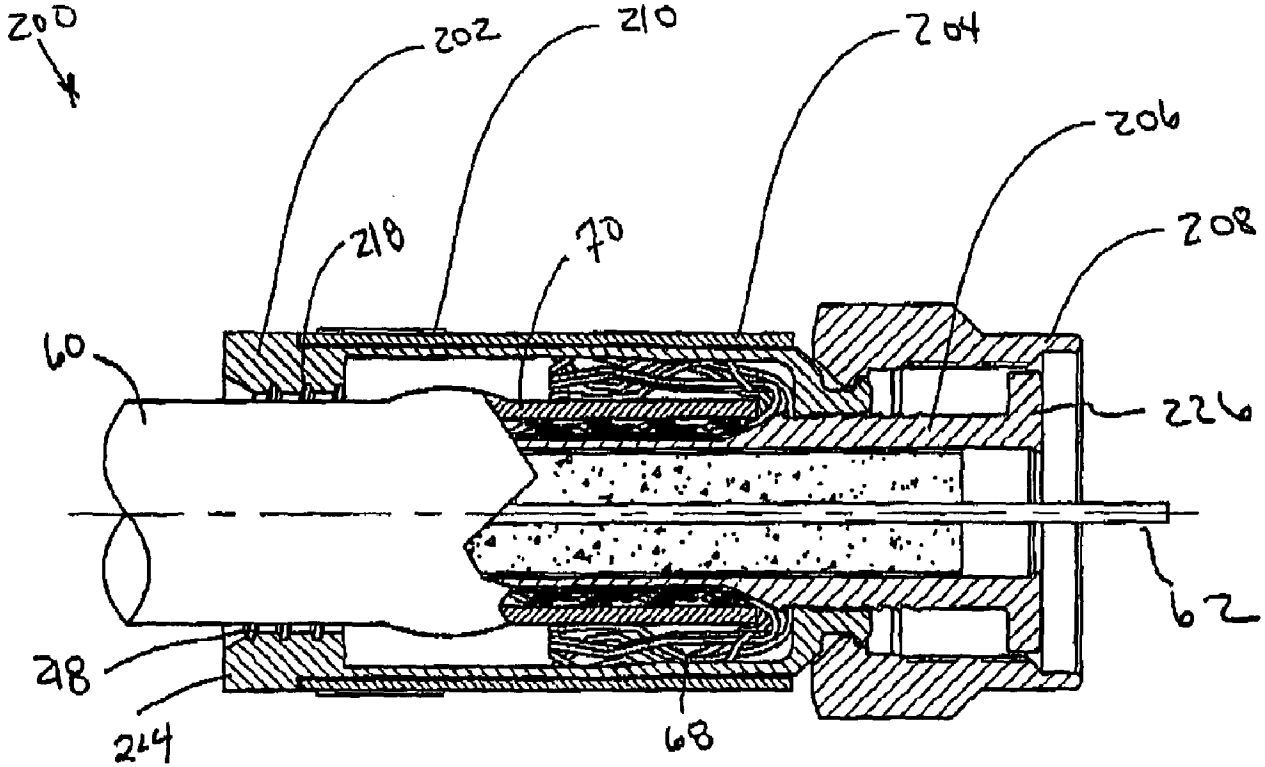
FIG. 13 is a side cutaway view of the coaxial cable connector of FIG. 10 with the braided shield drawn into the coaxial cable connector and the coaxial cable fully inserted, but prior to axial compression of the coaxial cable connector.

The coaxial cable 60 is fully inserted into the coaxial cable connector 200 in FIG. 13, but prior to axial compression. The coaxial cable jacket 70 and braided shield 68 are fully inserted into the outer body 202 and the inner conductor 62 extends through the coupling nut 208, but the tubular post 206 remains in the forward position, with the thread 218 and the projections 230 axially displaced from one another.

Figure 14:
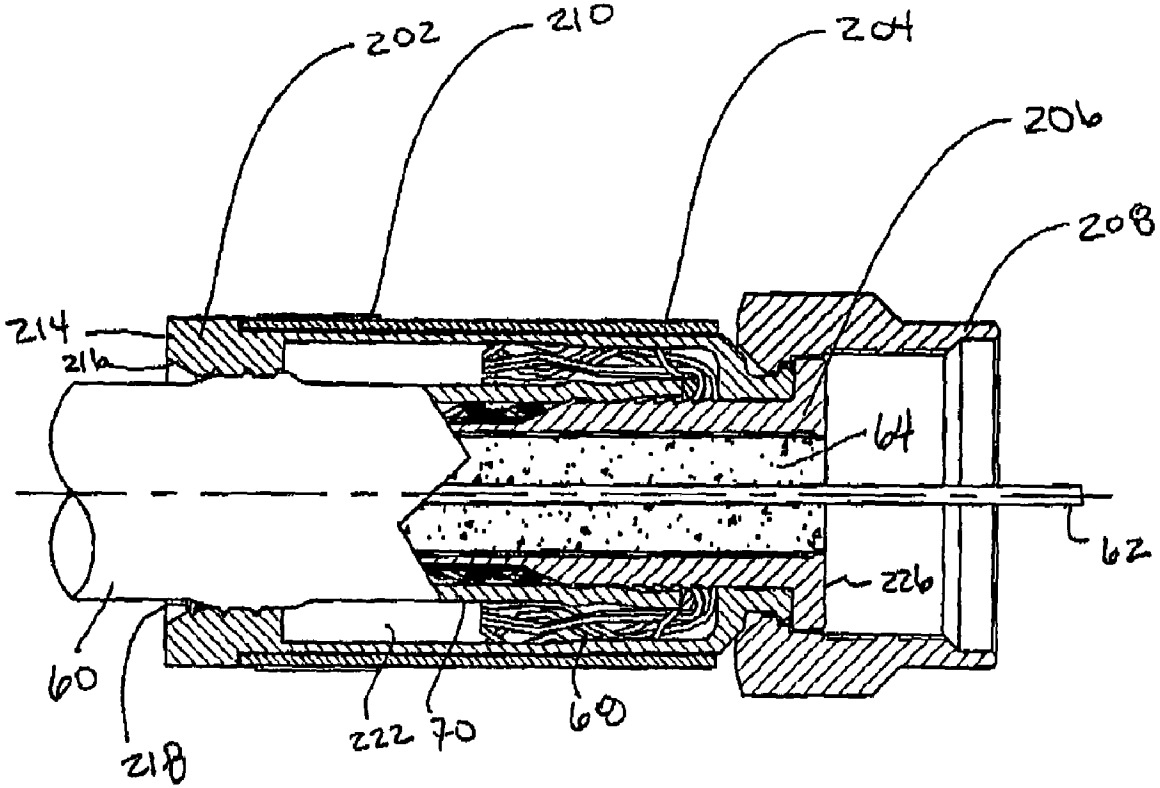
FIG. 14 is a side cutaway view of the coaxial cable connector of FIG. 13 after axial compression of the coaxial cable connector.

FIG. 14 illustrates the coaxial cable connector 200 after compression, which can be done with standard tools and methods. In this configuration, the tubular post 206 has been moved relative to the coupling nut 208, the outer body 202, and the coaxial cable 60. Preferably, the front end 226 of tubular post 206 is now even (flush) with the front end of the dielectric 62 (although that is not required, and might depend on the preparation technique for the cable and the skill of the technician). The rear end 228 of the tubular post 206 is now disposed at an axial position in line with the threaded region of the outer body and captures the cable jacket 70 and braided shield 68 between the projections 230 and the thread 218.

Another embodiment of a coaxial cable connector 300 is illustrated in FIGS. 15–16. Coaxial cable connector 300 has a hollow body 302 that has a longitudinal axis A—A. The hollow body 302 is preferably made from a metallic material, such as brass, and is preferably plated with a conductive, corrosion resistant material, such as nickel. Alternatively, the hollow body 302 may be made of a plastic material, such as acetyl. At the front end 304 of coaxial cable connector 300 is a coupler, shown as embodied by a coupling nut 306. The coupling nut 306 is shown with a generally hexagonal outer configuration with internal threads for engaging an appliance or junction having a terminal. The coupling nut 306 is also preferably made of a metallic material such as brass, it is preferably plated with a conductive, corrosion resistant material, such as nickel. At the front end of hollow body 302 is a nut retainer 308 that secures the coupling nut 306 to the hollow body 302. The nut retainer 308 is preferably made from the same material as the coupling nut 306. The nut retainer 308 provides limited axial movement while allowing full rotational motion of the coupling nut 306. Disposed within the nut retainer 308 is an insulator 320. The insulator 320 provides mechanical support and a guide for centering a pin 322. The insulator 320 also serves to electrically match the coaxial structure impedance of the connector, and is typically made of a nonconductive plastic material, such as acetyl. The pin 322 is preferably made of a metallic material, such as brass, and is plated with a conductive material, such as gold, tin, or nickel-tin.

A tubular post 324, disposed within a longitudinal opening 326 of hollow body 302, is preferably made from a metallic material such as brass, and is typically plated with a conductive, corrosion resistant material, such as tin or nickel-tin. The tubular post 324 has a front end 330 that engages the internal surface 328 of the hollow body 302 and a rear end 332 that preferably protrudes from the rear end 334 of the hollow body 302. The outer surface 336 of the tubular post 324 has at least one projection 338 to engage the coaxial cable 60. While three projections 338 are illustrated, there can be more or fewer and they may also have a helical configuration and still fall within the scope of the present invention. The projections may also be a thread as illustrated and described with reference to FIG. 8.

Disposed within the longitudinal opening 340 of tubular post 324 is a second insulator 342 that, in addition to insulator 320, provides mechanical support for the pin 322. It also acts as a guide for centering a pin 322 within the tubular post 324. Second insulator 342 is preferably made from a non-conductive plastic material, such as acetyl.

A contact 344 is mounted internally in pin 322 by means of the press-fit to provide electrical and mechanical engagement between the pin 322 and the inner conductor 62 of the coaxial cable 60 with a spring clip. The contact 344 is preferably made from a resilient, conductive material, such as beryllium copper and plated with a conductive material, such as gold.

The coaxial cable connector 300 also has an outer body 346 that is slideably attached to the hollow body 302 by use of a press-fit. The outer body 346 is preferably made from a metallic material, such as brass, and is preferably plated with a conductive, corrosion resistant material, such as nickel. As illustrated, the rear end 332 of tubular post 324 and a rear portion of hollow body 302 extend into a longitudinal opening 348 of outer body 346. The rear end 350 of outer body 346 has a chamfered portion 352 to assist in guiding the coaxial cable 60 into the longitudinal opening 348. Outer body 346 of coaxial cable connector 300 also has at least one thread 356 on the internal surface 358 adjacent the rear end 350. The thread 356 illustrated in the embodiment in FIGS. 15–16 has at least two complete, contiguous turns, but the thread 356 may have fewer or more, and the thread 356 may also be interrupted (i.e., not continuous) and still come within the scope of the present invention. As illustrated in the figures and as discussed above with reference to the other figures, the thread 356 acts like an auger to pull the coaxial cable 60 and braided shield 68 into the longitudinal opening 348 and particularly an annular cavity 360 formed by the outer surface 336 of the tubular post 324 and the inner surface 364 of the hollow body 302.

As illustrated in FIG. 15, the coaxial cable 60, having been prepared as is known in the art, is inserted into the longitudinal opening 348 of the outer body 346. The chamfered portion 352 assists directing the outer portion of the coaxial cable into the longitudinal opening 348. The inner conductor 62 engages the contact 344 of the pin 322.

The coaxial cable connector 300 is then rotated relative to the coaxial cable 60, causing the thread 356 to engage the braided shield 68 and cable jacket 70. The thread 356 acts like an auger to pull the coaxial cable 60 into the coaxial connector 300. As noted above, the amount of braided shield 68 may be too large for the coaxial cable to simply slip inside the coaxial cable connector 300. Thus, the coaxial cable connector 300 compresses the braided shield 68 and jacket 70 around the coaxial cable 60, providing grip to allow the coaxial cable 60 to be pulled into the coaxial connector 300. As can also be seen in FIG. 16, the front end of the dielectric 64 engages the rear end of the second insulator 342. As the coaxial cable 60 moves into the coaxial cable connector 300, the second insulator 342, the contact 344 (which is now in electrical communication with the inner conductor 62), and the pin 322 also move toward the front end 304 of the coaxial cable connector 300 along the longitudinal axis A—A as the dielectric 64 pushes the second insulator 342.

Once the coaxial cable 60 is as forward in the coaxial connector 300 as possible (as is the pin 322 in the coupling nut 316 and in a similar fashion as with the first embodiment), if the coaxial connector 300 is continued to be rotated relative to the coaxial cable 60, the thread 356 will pull the braided shield 68 more fully into the coaxial cable connector 300.

Once the coaxial cable connector 300 is correctly positioned on the coaxial cable 60 and the braided shield is drawn into the coaxial cable connector 300 (if so desired, or the extra braided shield 68 could be cut off), the coaxial cable connector 300 is axially compressed as is known in the art. The compression of the coaxial cable connector 300 causes the outer body 346 and hollow body 302 to move axially toward each other along axis A—A. The thread 356 will retain at least a portion of the braided shield 68 and jacket 70 as the outer body 346 moves forward relative to the coaxial cable 60 and into the annular cavity 360. As compression continues, a forward sloping portion 360 of the internal surface 358 of the outer body 346 engages the rear 334 of the hollow body 302 and deforms forward sloping portion 360 radially inward to engage the braided shield 68 and the cable jacket 70. The rear 334 of the outer body 346 may also be positioned between the thread 356 of the outer body 348 and the shielded braid 68 and/or cable jacket 70, as illustrated in FIG. 16. As can be seen in FIG. 16 (and as with the other embodiments), the thread 356 is axially positioned over the at least one projection 338 on the tubular post 324 to provide further grip between the coaxial cable 60 (and particularly the shielded braid 68 and cable jacket 70) and the coaxial cable connector 300. The shielded braid is also present in the annular cavity 360.

Another embodiment of a coaxial cable connector 400 according to the present invention is illustrated in FIG. 17. The coaxial cable connector 400 has a BNC interface, known in the art. However, there are differences in the coaxial cable connector 400 according to the present invention and prior art BNC connectors. The coaxial cable connector 400 has a longitudinal axis A—A and a hollow body 402. The hollow body 402 is preferably made from a metallic material, such as brass, and is preferably plated with a conductive, corrosion resistant material, such as nickel.

A tubular post 404, disposed within a longitudinal opening 406 of hollow body 402, is preferably made from a metallic material such as brass and is typically plated with a conductive, corrosion resistant material, such as tin or nickel-tin. The tubular post 404 has a front end 408 that engages the internal surface 410 of the hollow body 402 and a rear end 412 that preferably protrudes from the rear end 414 of the hollow body 404. The outer surface 416 of the tubular post 404 has at least one projection 418 to engage a coaxial cable. While three projections 418 are illustrated, here can be more or fewer and they may also have a helical configuration and still fall within the scope of the present invention. The projections may also be a thread as illustrated and described with reference to FIG. 8.

Disposed within the longitudinal opening 420 of tubular post 404 is a second insulator 424 that provides mechanical support for a pin 426. It also acts as a guide for centering a pin 426 within the tubular post 404. Second insulator 424 is preferably made from a non-conductive plastic material, such as acetyl.

A contact 428 is mounted internally in pin 426 by means of the press-fit to provide electrical and mechanical engagement between the pin 426 and the inner conductor 62 of the coaxial cable 60 with a spring clip. The contact 428 is preferably made from a resilient, conductive material, such as beryllium copper and plated with a conductive material, such as gold.

The coaxial cable connector 400 has an outer body 430 that is slideably mounted to the outer body 402 by use of barb/press-fit configuration. The outer body 430 is preferably made from a plastic material such as acetyl, but may also be constructed of an appropriate metallic material. As illustrated, the rear end 412 of tubular post 404 extends into a longitudinal opening 432 of outer body 430. The rear end 434 of outer body 430 has a chamfered portion 436 to assist in directing a coaxial cable into the outer body 430. Outer body 430 of coaxial cable connector 400 also has at least one thread 440 on the internal surface 442 adjacent the rear end 434. The thread 440 illustrated in the embodiment in FIG. 17 has two complete, contiguous turns, but the thread 440 may have fewer or more, and the thread 440 may also be interrupted (i.e., not continuous) and still come within the scope of the present invention. As illustrated in the figures and as discussed above with reference to the other figures, the thread 440 acts like an auger to pull the coaxial cable and braided shield into the longitudinal opening 432 and particularly an annular cavity 446 formed by the outer surface 416 of the tubular post 404 and the internal surface 442 of the outer body 430.

A shell 450 is press-fit over the outer body 430 to provide additional mechanical strength to the outer body 430. The shell 450 is preferably made of in the metal material, while the outer body 430 is typically made from a plastic material. The coaxial cable connector 400 may also have a label 452 to identify the coaxial cable connector 400.

As with the previous embodiments and particularly the first embodiment of coaxial cable connector 100 in FIGS. 2–7, the coaxial cable connector 400 is attached to a coaxial cable in the same manner as described above.

Threads on the internal surface of the outer body in any of the embodiments disclosed herein may have left-handed or right-handed rotational orientation. For example, the embodiment shown in FIG. 17 has threads with one given orientation, while other embodiments in other figures have an opposite orientation.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A connector for coupling an end of a coaxial cable to a terminal, the coaxial cable comprising an inner conductor, a dielectric surrounding the inner conductor, an outer conductor surrounding the dielectric, at least one braided shield surrounding the dielectric, and a jacket surrounding the at least one braided shield, the connector comprising:

an outer body comprising a rear end, a front end, a longitudinal axis, and an internal surface extending between the rear and front ends of the body, the internal surface defining a longitudinal opening and having a threaded region with at least one thread on at least a portion of the internal surface adjacent the rear end of the outer body;

a tubular post disposed at least partially within the longitudinal opening of the outer body, the tubular post comprising a rear end, an inner surface and an outer surface, the rear end of the tubular post having at least one protrusion on the outer surface, and wherein at least a portion of the outer surface of the tubular post and at least a portion of the internal surface of the outer body define an annular cavity therebetween; and a hollow body comprising a rear end, a front end, and an internal surface extending between the rear and front ends of the hollow body, the internal surface defining a longitudinal opening, wherein at least a portion of the tubular post is disposed in the longitudinal opening of the hollow body, and the tubular post is mounted to the hollow body;

wherein, in a first position, the outer body is in contact with the hollow body and the threaded region is longitudinally offset from the tubular post, and wherein the outer body and tubular post are movable relative to one another along the longitudinal axis to permit the threaded region of the outer body, in a second position, to surround at least part of the tubular post and to compress at least a portion of the coaxial cable in the connector between the tubular post and the outer body.

2. The connector according to claim 1, further comprising a pin inserted into a longitudinal opening defined by the inner surface of the tubular post, the pin configured to engage a portion of the inner conductor of the coaxial cable and to move axially in the connector relative to the tubular post.

3. The connector according to claim 1, the hollow body having a deformable portion proximate the rear end, the deformable portion being deformed radially inward by the axial movement of the outer body from a rearward position to a forward position.

4. The connector according to claim 1, further comprising a coupler disposed proximate the front end of the hollow body.

5. The connector according to claim 1, further comprising a coupler disposed proximate the front end of the connector.

6. The connector according to claim 1, wherein the at least one protrusion on the outer surface of the tubular post comprises at least one thread.

7. A connector for coupling an end of a coaxial cable to a terminal, the coaxial cable comprising an inner conductor, a dielectric surrounding the inner conductor, an outer conductor surrounding the dielectric, at least one braided shield surrounding the dielectric, and a jacket surrounding the at least one braided shield, the connector comprising:

an outer body comprising a rear end, a front end, a longitudinal axis, and an internal surface extending between the rear and front ends of the body, the internal surface defining a longitudinal opening and having a threaded region with at least one thread on at least a portion of the internal surface adjacent the rear end of the outer body;

a tubular post disposed at least partially within the longitudinal opening of the outer body, the tubular post comprising a rear end, an inner surface and an outer surface, the rear end of the tubular post having at least one protrusion on the outer surface, and wherein at least a portion of the outer surface of the tubular post and at least a portion of the internal surface of the outer body define an annular cavity therebetween; and a hollow body comprising a rear end, a front end, a deformable portion proximate the rear end of the hollow body and an internal surface extending between the rear and front ends of the hollow body, the internal surface defining a longitudinal opening, wherein at least a portion of the tubular post is disposed in the longitudinal opening of the hollow body, and wherein the tubular post is mounted to the hollow body;

wherein in a first position, the outer body is in contact with the hollow body and the threaded region is longitudinally offset from the tubular post, and wherein movement of the outer body and tubular post relative to one another along the longitudinal axis causes the threaded region of the outer body, in a second position to surround at least part of the tubular post and causes the deformable portion to deform radially inward toward the longitudinal axis sufficient to compress at least a portion of the coaxial cable between the deformable portion and the tubular post.

8. The connector according to claim 7, further comprising a pin inserted into a longitudinal opening defined by the inner surface of the tubular post, the pin configured to engage a portion of the inner conductor of the coaxial cable and to move axially in the connector relative to the tubular post.

9. The connector according to claim 7, further comprising a coupler disposed proximate the front end of the hollow body.

10. A combination of a coaxial cable and a connector for coupling an end of the coaxial cable to a terminal, the coaxial cable comprising an inner conductor, a dielectric surrounding the inner conductor, an outer conductor surrounding the dielectric, at least one braided shield surrounding the dielectric, and a jacket surrounding the at least one braided shield, the connector comprising:

an outer body comprising a rear end, a front end, a longitudinal axis and an internal surface extending between the rear and front ends of the body, the internal surface defining a longitudinal opening and having at least one thread proximate the rear end;

a tubular post disposed at least partially within the longitudinal opening of the hollow body, the tubular post comprising a rear end, an inner surface and an outer surface, the rear end of the tubular post having at least one projection on the outer surface, and wherein at least a portion of the outer surface of the tubular post and at least a portion of the internal surface of the hollow body define an annular cavity therebetween, wherein the inner surface of the tubular post is configured to allow the dielectric and the inner conductor to enter the tubular post and to allow the at least one braided shield and the jacket to enter the annular cavity over the at least one projection;

a hollow body comprising a rear end, a front end, and an internal surface extending between the rear and front ends of the hollow body, the internal surface defining a longitudinal opening, wherein at least a portion of the tubular post is disposed in the longitudinal opening of the hollow body, and the tubular post is mounted to the hollow body; and a pin disposed in the tubular post to engage the inner conductor;

wherein, in a first position, the outer body is in contact with the hollow body and the threaded region is longitudinally offset from the tubular post, and wherein the outer body and tubular post are movable relative to one another along the longitudinal axis to permit the threaded region of the outer body, in a second position, to surround at least part of the tubular post and to compress at least a portion of the coaxial cable in the connector between the tubular post and the outer body.

11. The connector according to claim 10, the hollow body having a deformable portion proximate the rear end, the deformable portion being deformed radially inward by the axial movement of the outer body from a rearward position to a forward position.

12. A method of coupling a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the method comprising:

providing a coaxial connector comprising a hollow body, an outer body in contact with the hollow body, and a tubular post mounted to the hollow body, the tubular post having at least one projection on an outer surface, the outer body being axially moveable relative to the hollow body and the tubular post and having a threaded region with at least one thread on an internal surface proximate a rear end of the outer body;

engaging the coaxial cable with the threaded region of the outer body of the connector while rotating the outer body with respect to the coaxial cable while the threaded region is longitudinally spaced away from the tubular post, wherein the at least one thread draws the braided shield and jacket into an annular opening between the outer body and the outer surface of the tubular post, thereby longitudinally advancing the coaxial connector onto the coaxial cable; and moving the outer body and the tubular post together to cause the threaded region of the outer body to surround at least part of the post and to grip the coaxial cable within the connector.

13. The method according to claim 12, wherein the coaxial connector further comprises a hollow body having a deformable portion adjacent a rear end, and wherein the step of moving the outer body causes the deformable portion of the hollow body to deform radially inward, thereby causing the deformable portion of the outer body and the tubular post to engage a portion of the coaxial cable.

14. The connector according to claim 1 wherein the outer body surrounds and contacts an outer surface of the hollow body.

15. The method according to claim 12 wherein the moving step causes a portion of the coaxial cable to be sandwiched between the outer body and the rear end of the tubular post.

16. The method according to claim 12 wherein the moving step causes a portion of the coaxial cable to be sandwiched between the hollow body and the rear end of the tubular post.

17. The method according to claim 12 wherein the moving step causes a portion of the hollow body to deform radially inwardly.

18. The method according to claim 12 wherein, during the moving step, the tubular post moves axially relative to the hollow body.

* * * * *